US007252152B2

(12) United States Patent
LoGiudice et al.

(10) Patent No.: US 7,252,152 B2
(45) Date of Patent: Aug. 7, 2007

(54) METHODS AND APPARATUS FOR ACTUATING A DOWNHOLE TOOL

(75) Inventors: Michael LoGiudice, Spring, TX (US); R. Lee Colvard, Tomball, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 182 days.

(21) Appl. No.: 10/464,433

(22) Filed: Jun. 18, 2003

(65) Prior Publication Data

US 2004/0256113 A1 Dec. 23, 2004

(51) Int. Cl.
*E21B 34/06* (2006.01)
*E21B 47/09* (2006.01)
*E21B 33/14* (2006.01)

(52) U.S. Cl. ..... 166/386; 166/250.14; 166/177.4; 166/66; 166/66.6; 166/53

(58) Field of Classification Search ..... 166/381, 166/250.14, 285, 153, 154, 177.4, 54, 66, 166/66.6, 386, 250.01, 53, 250.12
See application file for complete search history.

(56) References Cited

U.S. PATENT DOCUMENTS 3,457,994 A 7/1969 Stachowiak ..... 166/125
4,403,659 A 9/1983 Upchurch ..... 166/374
4,796,699 A 1/1989 Upchurch ..... 166/250
4,856,595 A 8/1989 Upchurch ..... 166/374
5,332,048 A 7/1994 Underwood et al.
5,343,963 A * 9/1994 Bouldin et al. ..... 175/27
5,358,035 A * 10/1994 Grudzinski ..... 166/53
5,575,333 A 11/1996 Lirette et al. ..... 166/241.1
5,788,000 A 8/1998 Maury et al.
5,832,996 A 11/1998 Carmody et al.
5,941,307 A * 8/1999 Tubel ..... 166/313

(Continued)

FOREIGN PATENT DOCUMENTS

EP 0 551 163 7/1993

(Continued)

OTHER PUBLICATIONS

U.K. Search Report, Application No. GB0413543.0, dated Sep. 13, 2004.

(Continued)

*Primary Examiner*—Kenneth Thompson
(74) *Attorney, Agent, or Firm*—Patterson & Sheridan, LLP

(57) ABSTRACT

The present invention relates to apparatus and methods for remotely actuating a downhole tool. In one aspect, the present invention provides an apparatus for activating a downhole tool in a wellbore, the downhole tool having an actuated and unactuated positions. The apparatus includes an actuator for operating the downhole tool between the actuated and unactuated positions; a controller for activating the actuator; and a sensor for detecting a condition in the wellbore, wherein the detected condition is transmitted to the controller, thereby causing the actuator to operate the downhole tool. In one embodiment, conditions in the wellbore are generated at the surface, which is later detected downhole. These conditions include changes in pressure, temperature, vibration, or flow rate. In another embodiment, a fiber optic signal may be transmitted downhole to the sensor. In another embodiment still, a radio frequency tag is dropped into the wellbore for detection by the sensor.

50 Claims, 7 Drawing Sheets

U.S. PATENT DOCUMENTS

| | | | | |
|---|---|---|---|---|
| 5,955,666 | A * | 9/1999 | Mullins | 73/152.18 |
| 5,960,881 | A | 10/1999 | Allamon et al. | 166/291 |
| 5,967,231 | A | 10/1999 | Laurel et al. | 166/250.04 |
| 6,041,857 | A | 3/2000 | Carmody et al. | |
| 6,082,459 | A | 7/2000 | Rogers et al. | 166/334.1 |
| 6,102,126 | A | 8/2000 | Huber et al. | 166/373 |
| 6,125,935 | A | 10/2000 | Shahin, Jr. | 166/250.14 |
| 6,131,658 | A | 10/2000 | Minear | 166/250.01 |
| 6,182,764 | B1 | 2/2001 | Vaynshteyn | 166/373 |
| 6,189,621 | B1 * | 2/2001 | Vail, III | 166/385 |
| 6,302,203 | B1 | 10/2001 | Rayssiguier et al. | 166/250.01 |
| 6,333,699 | B1 | 12/2001 | Zierolf | 340/854.8 |
| 6,349,766 | B1 * | 2/2002 | Bussear et al. | 166/113 |
| 6,359,569 | B2 * | 3/2002 | Beck et al. | 340/856.3 |
| 6,378,610 | B2 | 4/2002 | Rayssiguier et al. | 166/281 |
| 6,401,814 | B1 | 6/2002 | Owens et al. | 166/253.1 |
| 6,408,943 | B1 | 6/2002 | Schultz et al. | 166/285 |
| 6,429,784 | B1 | 8/2002 | Beique et al. | 340/853.2 |
| 6,439,306 | B1 | 8/2002 | Patel | 166/264 |
| 6,520,257 | B2 | 2/2003 | Allamon et al. | 166/291 |
| 6,776,240 | B2 * | 8/2004 | Kenison et al. | 166/330 |
| 6,789,619 | B2 * | 9/2004 | Carlson et al. | 166/250.04 |
| 6,915,848 | B2 * | 7/2005 | Thomeer et al. | 166/250.11 |
| 2002/0039465 | A1 | 4/2002 | Skinner | |
| 2002/0157828 | A1 | 10/2002 | King et al. | 166/285 |
| 2003/0010493 | A1 | 1/2003 | Hill et al. | 166/65.1 |
| 2003/0029611 | A1 | 2/2003 | Owens | 166/250.03 |
| 2003/0192695 | A1 * | 10/2003 | Dillenbeck et al. | 166/285 |
| 2004/0060697 | A1 * | 4/2004 | Tilton et al. | 166/253.1 |

FOREIGN PATENT DOCUMENTS

| | | |
|---|---|---|
| EP | 0 744 526 | 11/1996 |
| EP | 0 848 512 | 6/1998 |
| GB | 2 344 910 | 6/2000 |
| GB | 2 391 565 | 2/2004 |
| GB | 2 392 462 | 3/2004 |
| WO | WO 01/55554 | 8/2001 |
| WO | WO 03/033874 | 4/2003 |

OTHER PUBLICATIONS

"The Final Frontier: Fiber Optics Promise Real-Time Information On Well Drilling," *GTI Journal*, Winter/Spring 2002.

GTI's Friction Brake.

U.S. Appl. No. 10/259,214, filed Sep. 27, 2002, Tilton et al.

G.B. Search Report, Application No. GB0702579.4, dated Mar. 29, 2007.

* cited by examiner

METHODS AND APPARATUS FOR ACTUATING A DOWNHOLE TOOL

BACKGROUND OF THE INVENTION

1. Field of the Invention

Aspects of the present invention generally relate to operating a downhole tool. Particularly, the present invention relates to apparatus and methods for remotely actuating a downhole tool. More particularly, the present invention relates to apparatus and methods for actuating a downhole tool based on a monitored wellbore condition.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing or liner, is run into the well. In the case of a liner, the liner is set at a depth such that the upper portion of the liner overlaps the lower portion of the first string of casing. The liner is then fixed or "hung" off of the existing casing. A casing, on the other hand, is hung off of the surface and disposed concentrically with the first string of casing. Afterwards, the casing or liner is also cemented. This process is typically repeated with additional casings or liners until the well has been drilled to total depth. In this manner, wells are typically formed with two or more strings of casings of an ever-decreasing diameter.

In the process of forming a wellbore, it is sometimes desirable to utilize various tripping devices. Tripping devices are typically dropped or released into the wellbore to operate a downhole tool. The tripping device usually lands in a seat of the downhole tool, thereby causing the downhole tool to operate in a predetermined manner. Examples of tripping devices, among others, include balls, plugs, and darts.

Tripping devices are commonly used during the cementing operations for a casing or liner. The cementing process typically involves the use of liner wiper plugs and drill-pipe darts. A liner wiper plug is typically located inside the top of a liner, and is lowered into the wellbore with the liner at the bottom of a working string. The liner wiper plug typically defines an elongated elastomeric body used to separate fluids pumped into a wellbore. The plug has radial wipers to contact and wipe the inside of the liner as the plug travels down the liner. The liner wiper plug has a cylindrical bore through it to allow passage of fluids.

Generally, the tripping device is released from a cementing head apparatus at the top of the wellbore. The cementing head typically includes a dart releasing apparatus, referred to sometimes as a plug-dropping container. Darts used during a cementing operation are held at the surface by the plug-dropping container. The plug-dropping container is incorporated into the cementing head above the wellbore.

After a sufficient volume of circulating fluid or cement has been placed into the wellbore, a drill pipe dart or pump-down plug is deployed. Using drilling mud, cement, or other displacement fluid, the dart is pumped into the working string. As the dart travels downhole, it seats against the liner wiper plug, closing off the internal bore through the liner wiper plug. Hydraulic pressure above the dart forces the dart and the wiper plug to dislodge from the bottom of the working string and to be pumped down the liner together. This forces the circulating fluid or cement that is ahead of the wiper plug and dart to travel down the liner and out into the liner annulus.

Another common component of a cementing head or other fluid circulation system is a ball dropping assembly for releasing a ball into the pipe string. The ball may be dropped for many purposes. For instance, the ball may be dropped onto a seat located in the wellbore to close off the wellbore. Sealing off the wellbore allows pressure to be built up to actuate a downhole tool such as a packer, a liner hanger, a running tool, or a valve. The ball may also be dropped to shear a pin to operate a downhole tool. Balls are also sometimes used in cementing operations to divert the flow of cement during staged cementing operations. Balls are also used to convert float equipment.

There are drawbacks to using tripping devices such as a ball. For instance, because the tripping device must travel or be held within the string or the cementing head, the diameter of the tripping device is dictated by the inner diameters of the running string or the cementing head. Since the tripping device is designed to land in the downhole tool, the inner diameter of the downhole tool is, in turn, limited by the size of the tripping device. Limitations on the bore size of the downhole tool are a drawback of the efficiency of the downhole tool. Downhole tools having a large inner diameter are preferred because of the greater ability to reduce surge pressure on the formation and prevent plugging of the tool with debris in the well fluids.

Another drawback of tripping devices is reliability. In some instances, the tripping device does not securely seat in the downhole tool. It has also been observed that the tripping device does not reach the downhole tool due to obstructions. In these cases, the downhole tool is not caused to perform the intended operation, thereby increasing down time and costs.

Furthermore, cementing tools generally employ mechanical or hydraulic activation methods and may not provide adequate feedback about wellbore conditions or cement placement. For many cementing tools, balls, darts, cones, or cylinders are dropped or pumped inside of the tubular to physically activate the tools. Cementing operations may be delayed as the tripping device descends into the wellbore. Also, pressure increases monitored on the surface are usually the only indication that a tool has been activated. No information is available to determine the tool's condition, position, or proper operation. In addition, the location of the cement slurry is not positively known. The cement slurry position is typically an estimate based on volume calculations. Currently, no feedback is provided regarding cement height or placement in the annulus other than pressure indications.

There is a need, therefore, for an apparatus and method for remotely actuating a downhole tool. Further, there is a need for an apparatus and method to remotely actuate a float valve. The need also exists for an apparatus and method for actuating a centralizer. There is also a need for an apparatus and method for monitoring downhole conditions while running casing or cementing. There is a need still for an apparatus and method for determining cement location in a wellbore.

SUMMARY OF THE INVENTION

Aspects of the present invention generally relate to operating a downhole tool. Particularly, the present invention relates to apparatus and methods for remotely actuating a downhole tool.

In one aspect, the present invention provides an apparatus for activating a downhole tool in a wellbore, the downhole tool having an actuated and unactuated positions. The apparatus includes an actuator for operating the downhole tool between the actuated and unactuated positions; a controller for activating the actuator; and a sensor for detecting a condition in the wellbore, wherein the detected condition is transmitted to the controller, thereby causing the actuator to operate the downhole tool. In one embodiment, conditions in the wellbore are generated at the surface, which is later detected downhole. These conditions include changes in pressure, temperature, vibration, or flow rate. In another embodiment, a fiber optic signal may be transmitted downhole to the sensor. In another embodiment still, a radio frequency tag is dropped into the wellbore for detection by the sensor.

In another aspect, the controller may be adapted to actuate a tool based on the measured conditions in the wellbore not generated at the surface. For example, the controller may be programmed to actuate a tool at a predetermined depth as determined by the hydrostatic pressure. The controller may suitably be adapted to actuate the tool based other measured downhole conditions such as temperature, fluid density, fluid conductivity, and when well conditions warrant tool activation.

In another aspect, the present invention provides a method for activating a downhole tool. The method includes generating a condition downhole, detecting the condition, and signaling the detected condition. An actuator is then operated based on the detected condition to activate the downhole tool between an actuated and an unactuated positions.

In another aspect still, the present invention provides a method for remotely actuating a downhole tool. The method includes providing the downhole tool with a radio frequency tag reader and broadcasting a signal. Thereafter, a radio frequency tag is positioned proximate the downhole tool to receive and generate a reflected signal. The tag may be released into the wellbore and pumped downhole. In one embodiment, the tag is disposed on a carrier such as a tripping device or cementing apparatus and pumped downhole. Then, the downhole tool is actuated according to the reflected signal.

In another embodiment, the sensor may be adapted to detect downhole devices such as cementing plugs and darts being pumped past the tool. In turn, the controller may be programmed to initiate actuation based on the presence of the detected device. For example, a tool may be equipped with sensors to acoustically or vibrationally detect the passing of a cementing dart, which causes the controller to actuate the tool.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 5 also shows a radio frequency tag traveling in the wellbore.

DETAILED DESCRIPTION OF THE PREFERRED EMBODIMENT

Aspects of the present invention generally relate to operating a downhole tool. Particularly, the present invention relates to apparatus and methods for remotely actuating a downhole tool. In one aspect, the present invention provides a sensor, controller, and an actuator for actuating the downhole tool. The sensor is adapted to monitor, detect, or measure conditions in the wellbore. The sensor may transmit the detected conditions to the controller, which is adapted to operate the downhole tool according to a predetermined downhole tool control circuit.

Remotely Actuated Float Valve Assembly

Figure 1:
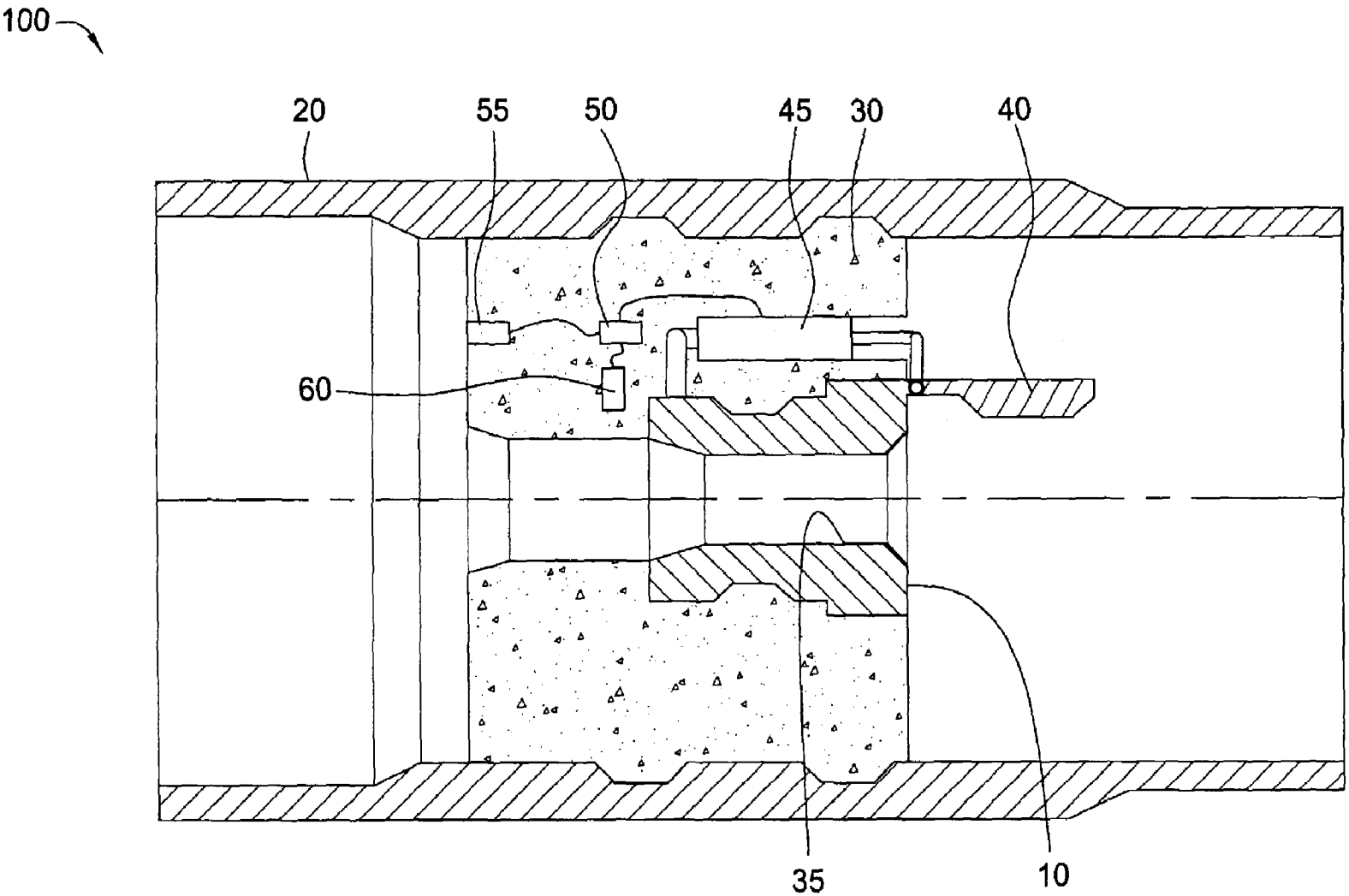
FIG. 1 is a cross-sectional view of a remotely actuated float valve according to aspects of the present invention.

FIG. 1 is a schematic illustration of a remotely actuatable float valve assembly 100 according to aspects of the present invention. As shown, a float valve 10 is disposed in a float collar 20. The float collar 20 may be assembled as part of the float shoe. Additionally, the float valve 20 may attach directly to the float shoe. In one embodiment, cement 30 is used to mount the float valve 10 to the float collar 20. The float valve 10 may also be mounted using plastic, epoxy, or other material known to a person of ordinary skill in the art. Moreover, it is contemplated that the float valve 10 may be mounted directly to the float collar 20. The float valve 10 defines a bore 35 therethrough for fluid communication above and below the float valve 10. A flapper 40 is used to regulate fluid flow through the bore 35.

In one aspect, the float valve 10 is adapted for remote actuation. In FIG. 1, the float valve 10 includes an actuator 45 to actuate the flapper 40. An exemplary actuator 45 includes a linear actuator adapted to open or close the flapper 40. The float valve 10 is also equipped with one or more sensors 55 and a controller 50 to activate the actuator 45. The sensors 55 may comprise any combination of suitable sensors, such as acoustic, electromagnetic, flow rate, pressure, vibration, temperature transducer, and radio receiver. Additionally, a signal may be transmitted through a fiber optics cable to the sensor 55. Data received or measured by the sensors 55 may be transmitted to the controller 50.

The controller 50, or valve control circuit, may be any suitable circuitry to autonomously control the float valve 10 by activating the actuator 45 according to a predetermined valve control sequence. The controller 50 comprises a microprocessor in communication with a memory. The microprocessor may be any suitable type microprocessor configured to perform the valve control sequence. In another embodiment, the controller 50 may also include circuitry for wireless communication of data from the sensors 55.

The memory may be internal or external to the microprocessor and may be any suitable type memory. For example, the memory may be a battery backed volatile memory or a non-volatile memory, such as a one-time programmable memory or a flash memory. Further, the memory may be any combination of suitable external or internal memories.

The memory may store a valve control sequence and a data log. The data log may store data read from the sensors 55. For example, subsequent to operating the valve 10, the data log may be uploaded from the memory to provide an operator with valuable information regarding operating conditions. The valve control sequence may be stored in any format suitable for execution by the microprocessor. For example, the valve control sequence may be store as executable program instructions. For some embodiments, the valve control sequence may be generated on a computer using any suitable programming tool or editor.

The float valve 10 may also include a battery 60 to power the controller 50, the sensor 55, and the actuator 45. The battery 60 may be an internal or external battery. In another embodiment, the components 45, 50, 55 may share or individually equipped with a battery 60.

In another aspect, the float valve 10 and the components 45, 50, 55, 60 are made of a drillable material. Further, it should be noted that the components 45, 50, 55, 60 may be extended temperature components suitable for downhole use (downhole temperatures may reach or exceed 300° F.).

In operation, the float collar 20 and the float valve 10 are installed as part of a liner (or casing) and float shoe assembly for cementing operations. The float valve 10 is lowered into the wellbore in the automatic fill position, thereby allowing wellbore fluid to enter the liner (or casing) and facilitate lowering of the liner (or casing). At any point during the cementing operation, the float valve 10 may be caused to open or close. A signal, such as an increase in pressure or a predetermined pressure pattern, may be sent from the surface to the sensor 55. The increase in pressure may be detected by the sensor 55, which, in turn, sends a signal to the controller 50. The controller 50 may process the signal from the sensor 55 and activate the actuator 45, thereby closing the flapper 40.

Figure 2:
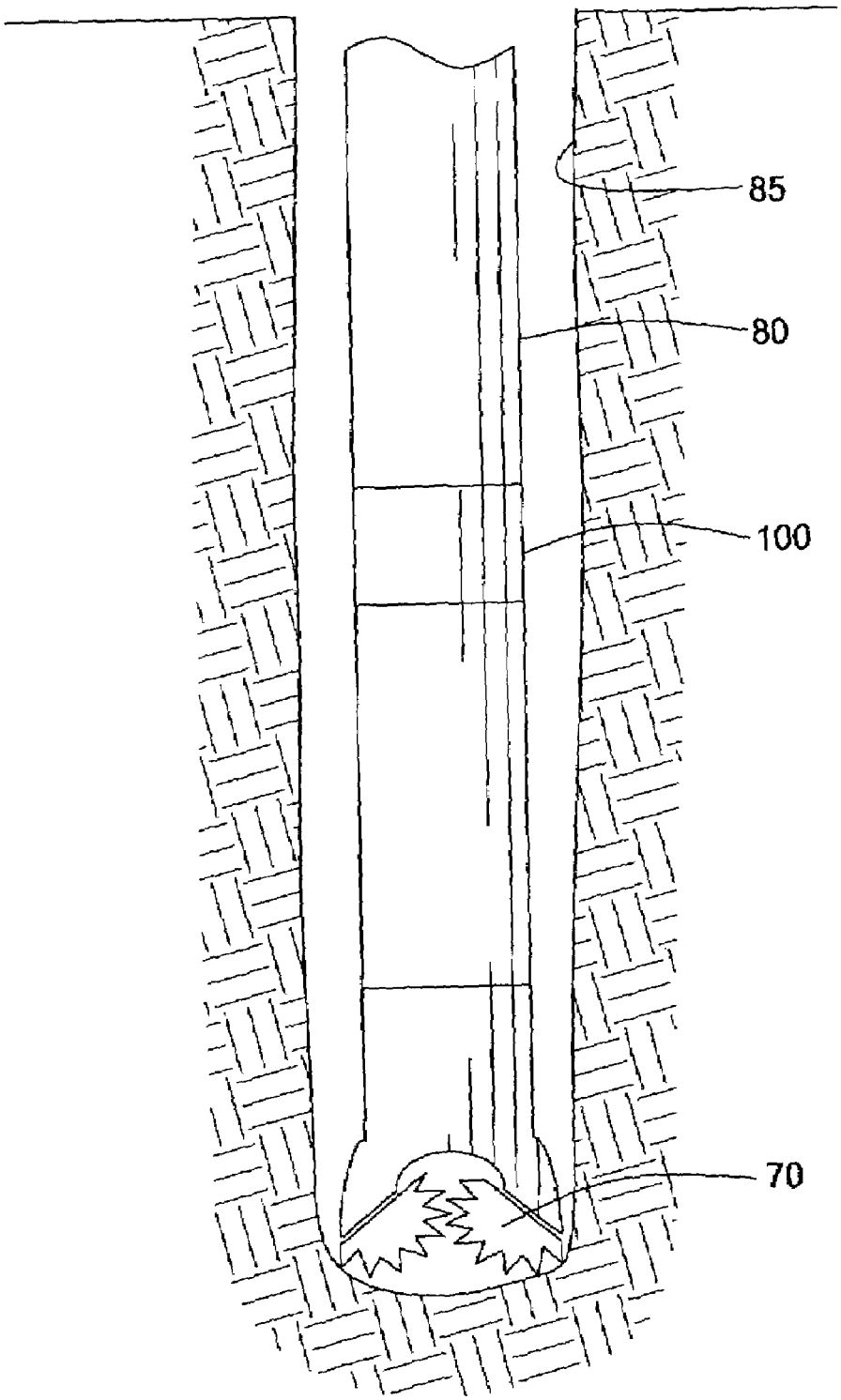
FIG. 2 is a schematic view of a remotely actuated float valve assembly disposed on a drilling with casing assembly.

Aspects of the present invention may also be applied in a drilling with casing operation. In one embodiment, the float valve assembly 100 is installed on a casing 80 having a drilling assembly 70, as illustrated in FIG. 2. The drilling assembly 70 may be rotated to extend the wellbore 85. During drilling, the flapper 40 is maintained in the automatic fill position, thereby allowing drilling fluid from the surface to exit the drilling assembly 70. Signals may be sent to the float valve to open or close the flapper at anytime during operation. It should be noted that the sensor 55 may also be adapted to operate the actuator 45 based on the detected conditions in the wellbore without deviating from aspects of the present invention. For example, the sensor may be adapted to detect the presence of other devices such as a cementing plug or dart by detecting changes in acoustics or vibration.

It must be noted that aspects of the present invention contemplate the use of any type of actuator or actuating mechanism known to a person of ordinary skill in the art to actuate the tool. Examples include an electrically operated solenoid, a motor, and a rotary motion. Additional examples include a shearable membrane that, when broken, allows pressure to enter a chamber to provide actuation. The controller may also be programmed to release a chemical to dissolve an element to port pressure into a chamber to provide actuation of the tool.

Advantages of the present invention include operating the float valve at anytime when well control issues occur. A remotely actuated float valve increases the bore size, because it is no longer restricted by the size of a tripping device, thereby increasing the float valve's capacity to reduce surge pressure on well formations. The increase in bore size will also reduce the potential of plugging caused by well debris. Additionally, cost savings from reduced rig time may be obtained. For example, a remotely actuated float valve may eliminate the need to wait for a tripping device to fall or pumped to the float valve.

Remotely Actuated Centralizer

Figure 3:
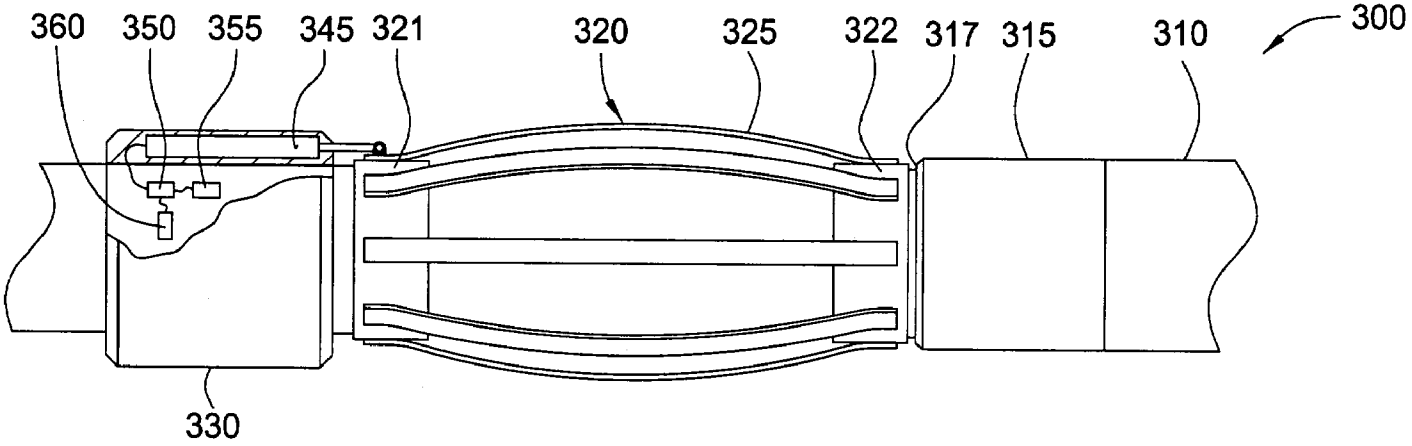
FIG. 3 is a view of a remotely actuated centralizer in the unactuated position.

In another aspect, the present invention provides a remotely actuated centralizer and methods for operating the same. FIG. 3 shows a remotely actuated centralizer assembly 300 installed on a casing string 310. As shown, the centralizer assembly 300 is in the unactuated position. The assembly 300 may be used with conventional drilling applications or drilling with casing applications. It should be noted that the centralizer assembly 300 may also be installed on other types of wellbore tubulars, such as drill pipe and liner.

The centralizer assembly 300 includes a centralizer 320 disposed on a mounting sub 315. As shown, the centralizer 320 is a bow spring centralizer. In one embodiment, the centralizer 320 includes a first collar 321 and a second collar 322 movably disposed around the mounting sub 315. The centralizer 320 also includes a plurality of bow springs 325 radially disposed around the collars 321, 322 and connected thereto. Particularly, the ends of the bow springs 325 are connected to a respective collar 321, 322 and biased outwardly. When the collars 321, 322 are brought closer together, the bow springs 325 bend outwardly to expand the outer diameter of the centralizer 320. A suitable centralizer for use with the present invention is disclosed in U.S. Pat. No. 5,575,333 issued to Lirette, et al.

The assembly 300 also includes a sleeve 330 disposed adjacent to the centralizer 320. The sleeve 330 includes an actuator 345 for activating the centralizer 320. A suitable actuator 345 includes a linear actuator adapted to expand or contract the centralizer 320. In one embodiment, the sleeve 330 is fixedly attached to the mounting sub 315. The centralizer 320 is positioned adjacent to the sleeve 330 such that the first collar 321 is closer to the sleeve 330 and connected to the actuator 345, while the second collar 322 contacts (or is adjacent to) an abutment 317 on the mounting sub 315.

The assembly also includes a sensor 355, controller 350, and battery 360 for operating the actuator 345. The sensor 55, controller 50, and battery 60 setup for float valve assembly 100 may be adapted to remotely operate the centralizer 320. Particularly, the controller 350, or centralizer control circuit, may be any suitable circuitry to autonomously control the centralizer by activating the actuator 345 according to a predetermined centralizer control sequence.

The controller 350 comprises a microprocessor in communication with memory. The sensors 355 may comprise any combination of suitable sensors, such as acoustic, electromagnetic, flow rate, pressure, vibration, temperature transducer, and radio receiver. Additionally, a signal may be transmitted through a fiber optics cable to the sensor 355. Preferably, the components 350, 355, 360 are mounted to the sleeve 330 such that the sleeve 330 may protect the components 350, 355, 360 from the environment downhole.

In operation, the centralizer 320 is disposed on a drilling with casing assembly and lowered into the wellbore in the unactuated position as shown in FIG. 3. The centralizer 320 may be actuated at any time during operation. A signal, such as an increase in pressure or a predetermined pressure pattern, may be sent from the surface to the sensor 355. After detecting the change in pressure, the sensor 355 may, in turn, send a signal to the controller 350. After processing the signal, the controller 350 may activate the actuator 345, thereby actuating the centralizer 320. It is understood that the sensor may be adapted to detect for other changes in the wellbore as is known to a person of ordinary skill in the art. For example, the sensor may detect for any acoustics changes in the wellbore created by the presence of other devices pumped past the centralizer.

Figure 4:
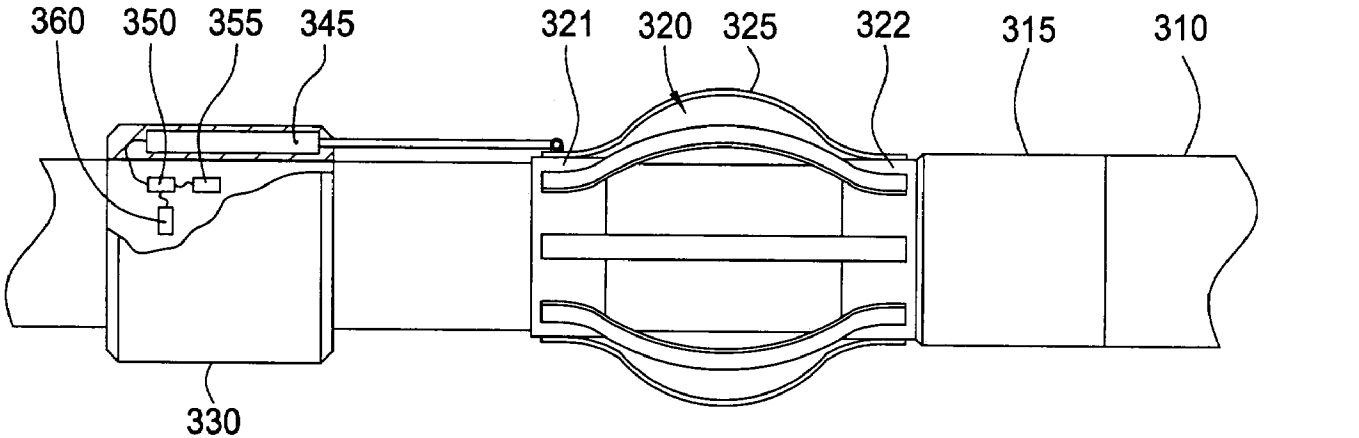
FIG. 4 is a view of the centralizer of FIG. 3 in the actuated position.

Particularly, when the controller 350 receives the signal to actuate the centralizer 320, the actuator 345 causes the first collar 321 to move closer to the second collar 322. As a result, the bow springs 325 are compressed and forced to bend outward into contact with the wellbore, as illustrated in FIG. 4. In this manner, the centralizer 320 may be activated at any time to centralize the casing. It must be noted that aspects of the present invention are equally applicable to a conventional liner or casing running operations.

Advantages of the present invention include providing a remotely actuatable centralizer. The centralizer may be expanded or contracted at any time to pass wellbore restrictions or to effectively center the casing in the wellbore. Additionally, the remotely actuated casing centralizer may provide greater centering force in underreamed holes. In underreamed holes, the centralizer may be actuated to increase the centering force above forces generated by traditional bow spring centralizers.

Remotely Actuated Flow Control Apparatus

Figure 5:
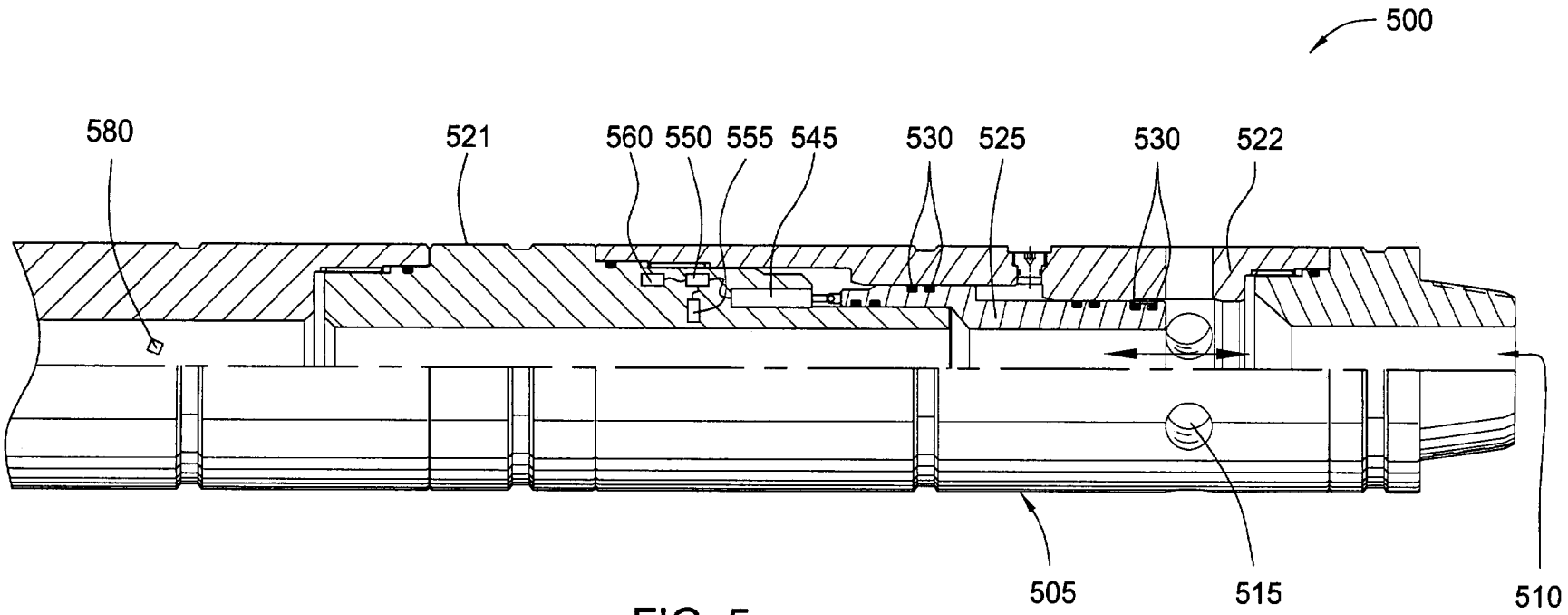
FIG. 5 is a cross-sectional view of a remotely actuated flow control apparatus.

In another aspect, the present invention provides a remotely actuatable flow control apparatus 500 and methods for operating the same. FIG. 5 shows a remotely actuatable flow control apparatus 500. Applications of the flow control apparatus 500 include being used as part of a casing circulation diverter apparatus, stage cementing apparatus, or other downhole fluid flow regulating apparatus known to a person of ordinary skill in the art.

As shown in FIG. 5, the flow control apparatus 500 includes a body 505 having a bore 510 therethrough. The body 505 may comprise an upper sub 521, a lower sub 522, and a sliding sleeve 525 disposed therebetween. The upper and lower subs 521, 522 may include tubular couplings for connection to one or more wellbore tubulars. A series of bypass ports 515 are formed in the body 505 for fluid communication between the interior and the exterior of the apparatus 500. One or more seals 530 are provided to prevent leakage between the sleeve 525 and the subs 521, 522. The sliding sleeve 525 may be adapted to remotely open or close the bypass ports 515 for fluid communication.

In one embodiment, the apparatus 500 includes an actuator for activating the sliding sleeve 525. A suitable actuator 545 includes a linear actuator adapted to axially move the sliding sleeve 525. The flow control apparatus includes a sensor 555, controller 550, and battery 560 for operating the actuator 545. The sensor 55, controller 50, and battery 60 setup for float valve assembly 100 may be adapted to remotely operate the flow control apparatus 500. Particularly, the controller 550, or flow control circuit, may be any suitable circuitry to autonomously control the flow control apparatus by activating the actuator 545 according to a predetermined flow control sequence. The controller 550 comprises a microprocessor in communication with memory. The sensors 555 may comprise any combination of suitable sensors, such as acoustic, electromagnetic, flow rate, pressure, vibration, temperature transducer, and radio receiver. Additionally, a signal may be transmitted through a fiber optics cable to the sensor 555. The sensor 555 may be configured to receive signals in the bore of the apparatus 500. Therefore, a signal transmitted from the surface may be received by the sensor 555 and processed by the controller 550.

In operation, the flow control apparatus 500 may be assembled as part of a casing circulation diverter tool. The apparatus 500 may be lowered into the wellbore in the open position as shown in the FIG. 5. To close the bypass ports 525, a signal may be sent from the surface to the sensor 555. For example, a predetermined flow rate pattern, such as a repeating square wave with 0 to 3 bbl/min amplitude and 1 minute period, may be produced at the surface. This change in flow rate may be detected by the sensor 555 and recognized by the controller 550. In turn, the controller 550 may activate the actuator 545 to move the sliding sleeve 525, thereby closing the bypass ports 515. It is understood the controller 550 may be adapted to partially open or close the bypass ports 515 to control the flow rate therethrough.

Advantages of the present invention include providing a remotely actuatable flow control apparatus. The bypass ports of the flow control apparatus may be opened or closed at any time to regulate the fluid flow therethrough. Additionally, the remotely actuated flow control apparatus may be repeatedly opened or closed to provide greater and increase the usefulness of the apparatus. Also, the apparatus' maximum bore size will not be restricted by the size of the tripping device. In addition to the sliding sleeve type of flow control apparatus shown in FIG. 5, aspects of the present invention are equally applicable to remotely actuate other types of flow control apparatus known to a person of ordinary skill in the art.

Remotely Actuated Instrumented Collar

In another aspect, the present invention provides a remotely actuated instrumented collar capable of measuring downhole conditions. The instrumented collar may be attached to a casing, liner, or other wellbore tubulars to provide the tubular with an apparatus for acquiring information downhole and transmitting the acquired information.

Figure 6:
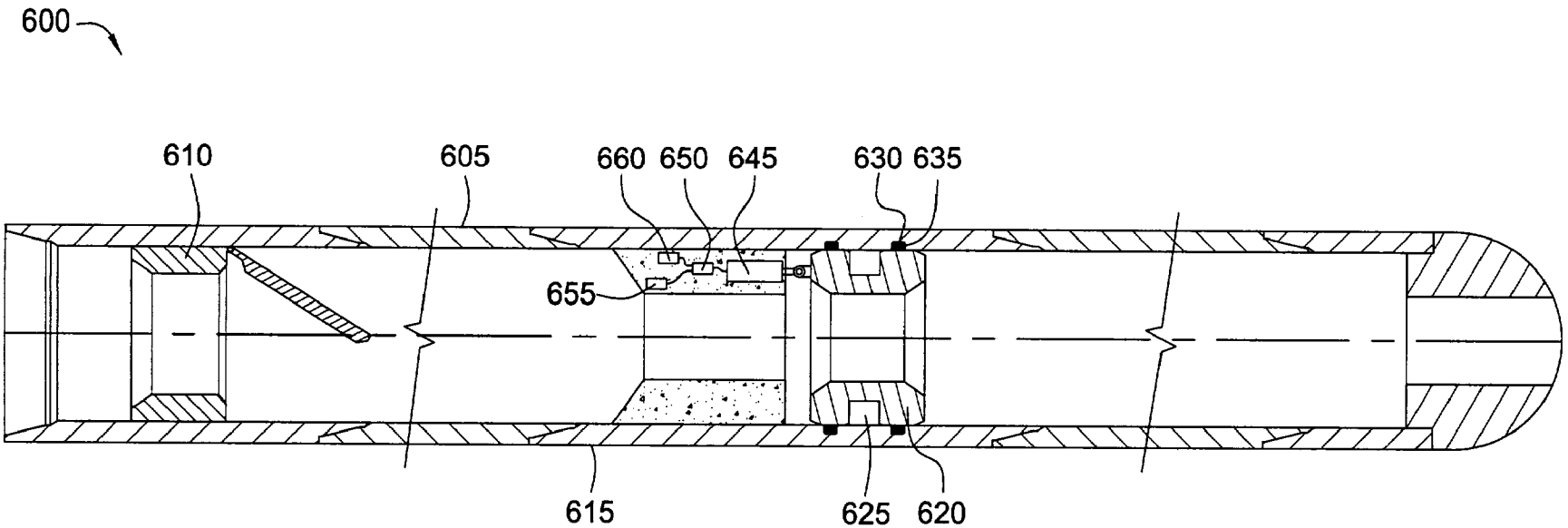
FIG. 6 is a cross-sectional view of an instrumented collar disposed on a shoe track.

In one embodiment, the instrumented collar 600 may be connected to shoe track 605 to monitor cement placement or downhole pressure. FIG. 6 illustrates an exemplary shoe track 605 having an instrumented collar 600 connected thereto. The instrumented collar 600 is disposed downstream from a float valve 610 that regulates fluid flow in the shoe track 605. It is understood that the instrumented collar 600 may also be placed upstream from the float valve 610.

The instrumented collar 600 comprises a tubular housing 615 having an operating sleeve 620 movably disposed therein. A vacuum chamber 625 is formed between the operating sleeve 620 and the tubular housing 615. The vacuum chamber 625 is fluidly sealed by one or more seal members 630. In one embodiment, the seal members 630 are disposed in a groove 635 between the operating sleeve 620 and the housing 615. When the operating sleeve 620 is caused to move axially along the housing 615, the seal between operating sleeve 620 and the housing 615 is broken. In this respect, fluid in the housing 615 may fill the vacuum chamber 625, thereby creating a negative pressure pulse that may be detected at the surface.

The operating sleeve 620 may be activated by an actuator 645 coupled thereto. The actuator 645 may be remotely actuated by sending a signal to a sensor 655 in the housing 615. In turn, the sensor 655 may transmit the signal to a controller 650 for processing and actuation of the actuator 645. An exemplary actuator 645 may be a linear actuator adapted to move the operating sleeve 620. The controller 650, or sleeve control circuit, may be any suitable circuitry to autonomously control the operating sleeve 620 by activating the operating sleeve 620 according to a predetermined sleeve control sequence. The controller 650 may comprise a microprocessor and a memory. Alternatively, the controller 650 may be equipped with a transmitter to transmit a signal to the surface to relay downhole condition information. Transmittal of information may be continuous or a one time event. Suitable telemetry methods include pressure pulses, fiber-optic cable, acoustic signals, radio signals, and electromagnetic signals.

The sensors 655 may comprise any combination of suitable sensors, such as acoustic, electromagnetic, flow rate, pressure, vibration, temperature transducer, and radio receiver. As such, the sensor 655 may be configured to monitor downhole conditions including, flow rate, pressure, temperature, conductivity, vibration, or acoustics. In another embodiment, the sensor 655 may comprise a transducer to transmit the appropriate signal to the controller 650. Preferably, these instruments are made of a drillable material or a material capable of withstanding downhole conditions such as high temperature and pressure.

In operation, the instrumented collar 600 of the present invention may be used to determine cement location. In one embodiment, the sensor 655 is a temperature sensor. Because cement is exothermic, the sensor 655 may detect an increase in temperature as the cement arrives or when the cement passes. The change in temperature is transmitted to the controller 650, which activates the actuator 645 according to the predetermined sleeve control circuit. The actuator 645 moves the operating sleeve 620 relative to the seal members 630 thereby breaking the seal between the operating sleeve 620 and the housing 615. As a result, fluid in the housing 615 fills the vacuum chamber 625, thereby causing a negative pressure pulse that is detected at the surface. In this manner, a shoe track 605 may be equipped with an instrumented collar 600 to measure or monitor conditions downhole.

In another embodiment, the sensor 655 may be a pressure sensor. Because cement has a different density than displacement fluid, a change in pressure caused by the cement may be detected. Other types of sensors 655 include sensors for measuring conductivity to determine if cement is located proximate the collar. By monitoring the appropriate condition, the position of the cement in the annulus may be transmitted to the surface and determined to insure that the cement is properly placed.

In another aspect, the instrumented collar 600 may be used to facilitate running casing. In one embodiment, the sensor 655 may monitor for excessive downhole pressures caused by running the casing into the wellbore. The sensor may detect and communicate the excessive pressure to the surface, thereby allowing appropriate actions (such as reduce running speeds) to be taken to avoid formation damage.

Radio Frequency Identification Tag Actuation

In another aspect, the sensors for monitoring conditions in the wellbore may comprise a radio frequency ("R.F.") tag reader. For example, the sensor 555 of the flow control apparatus 500 may be adapted to monitor for a RF tag 580 traveling in the bore 510 thereof, as shown in FIG. 5. The RF tag 80 may be adapted to instruct or provide a predetermined signal to the sensor 555. After detecting the signal from the RF tag 80, the sensor 555 may transmit the detected signal to the controller 550 for processing. In turn, the controller 550 may operate the sliding sleeve 525 in accordance with the flow control sequence.

In one embodiment, the RF tag 580 may be a passive tag having a transmitter and a circuit. The RF tag 580 is adapted to alter or modify an incoming signal in a predetermined manner and reflects back the altered or modified signal. Therefore, each RF tag 580 may be configured to provide operational instructions to the controller. For example, the RF tag 580 may signal the controller 550 to choke the bypass ports 515 or fully close the ports 515. In another embodiment, the RF tag 580 may be equipped with a battery 560 to boost the reflected signal or to provide its own signal.

Figure 7:
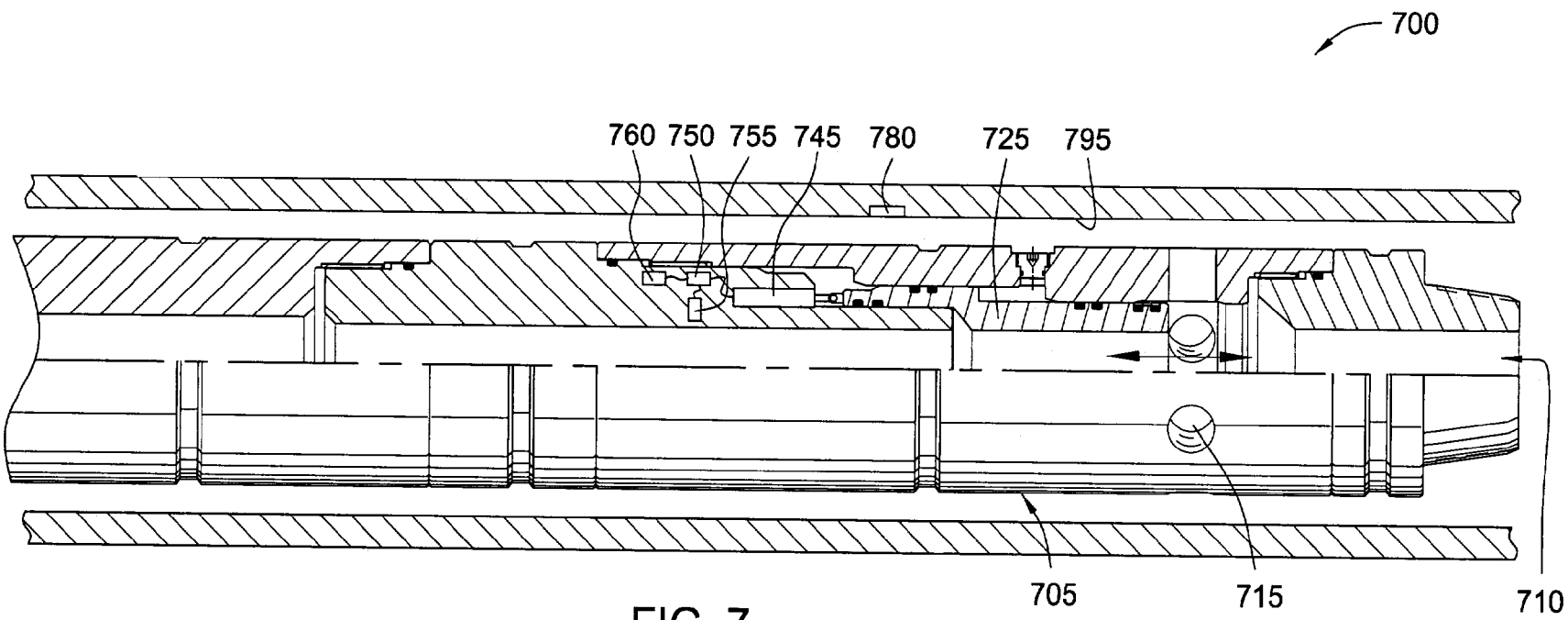
FIG. 7 is a partial cross-sectional view of a remotely actuated flow control apparatus disposed in a cased wellbore.

In another embodiment still, the RF tag 780 may be pre-placed at a predetermined location in a cased wellbore 795 to actuate a tool passing by, as illustrated in FIG. 7. For example, a diverter tool 700 may be equipped with a RF tag reader 755 and a controller 750 adapted to open or close the diverter tool 700. As the diverter tool 700 is run into the wellbore 795, the RF tag reader 755 broadcasts a signal in the wellbore 795. When the diverter tool 700 is near the pre-positioned tag 780, the tag 780 may receive the broadcasted signal and reflect back a modified signal, which is detected by the RF tag reader 755. In turn, the RF tag reader 755 sends a signal to the controller 750 to cause the actuator 745 to activate valve 725, thereby closing the ports 715 of the diverter tool 700. In this manner, the diverter tool 700 may be closed at the desired location in the wellbore 795.

Figure 8:
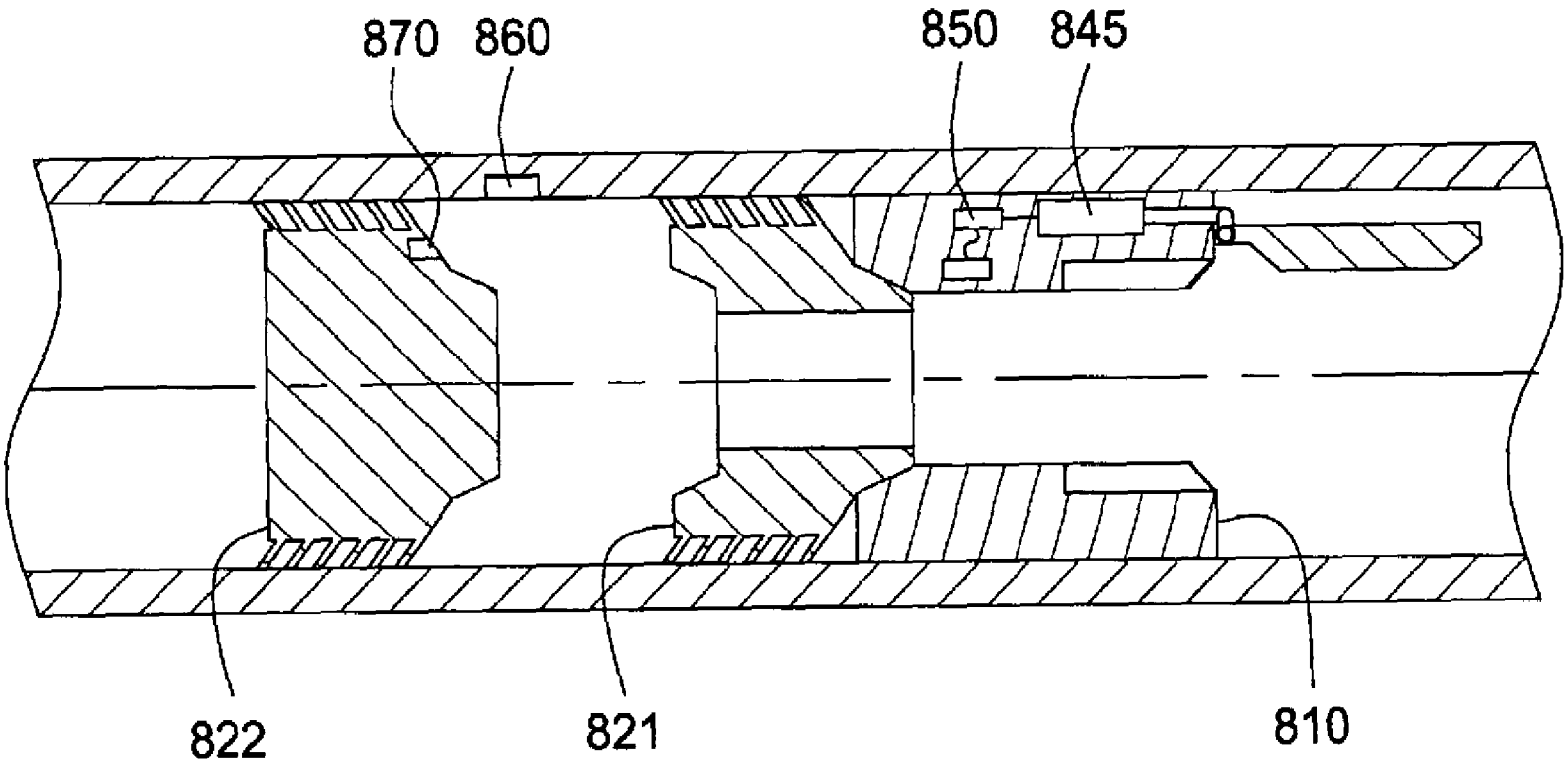
FIG. 8 is a cross-sectional view of a remotely actuated float valve actuated by a plug.

In another embodiment, as shown in FIG. 8, the RF tag 870 may be installed on a wiper (top) plug 822 and a RF tag reader 860 installed on a float valve 810. As the plug 822 reaches the float valve 810, the reflected signal from the RF tag 870 is received by the RF tag reader 860. This, in turn, instructs the controller 850 to cause the actuator 845 to close the valve 810. It is contemplated that the RF tag 870 may be disposed on the exterior of the wiper plug 822. Further, the RF tag reader 860 may communicate with the controller 850 using a wire, cable, wireless, or other forms of communication known to a person of ordinary skill in the art without deviating from aspects of the present invention.

In another aspect, multiple operational cycles may be achieved by dropping more than one RF tag. In this respect, a valve may be repeatedly opened or closed. The valve may also be closed in stages or increments as each tag passes by the valve. In the case of a float shoe or auto-fill device, a multiple step closing sequence may limit the auto-fill volumes as the tubular is run in.

In another aspect still, a RF tag may operate more than one tool as it travels in the wellbore. In one embodiment, the tag may pass through a first tool and cause actuation thereof. Thereafter, the tag may continue to travel downhole to actuate a second tool.

In another embodiment, a plurality of identically signatured (coded) RF tags may be released, dropped, or pumped into the wellbore simultaneously to actuate a tool. In this respect, the release of multiple RF tags will ensure detection of at least one of these tags by the tool. In another aspect, the RF tags may be released from a cementing head, a manifold device, or other apparatus known to a person of ordinary skill in the art.

It is understood that RF tag/read system may be adapted to remotely actuate a downhole tool. Examples of the downhole tool include, but not limited to, a float valve assembly, centralizer, flow control apparatus, an instrumented collar, and other downhole tools requiring remote actuation as is known to a person of ordinary skill in the art.

While the foregoing is directed to embodiments of the present invention, other and further embodiments of the invention may be devised without departing from the basic scope thereof, and the scope thereof is determined by the claims that follow.

We claim:

1. A method for activating a downhole valve, comprising:
- providing the downhole valve with a sensor, the downhole valve comprising:
  - a collar;
  - a float valve; and
  - a drillable material for coupling the float valve to the collar;
- sensing a condition with the sensor;
- signaling the condition;
- operating an actuator based on the condition, wherein the actuator activates the downhole valve between an opened and a closed position; and
- circulating cement past the valve in the opened position.

2. The method of claim 1, wherein the sensor signals the condition to a controller.

3. The method of claim 1, further comprising drilling with a casing which is coupled to the valve.

4. The method of claim 1, wherein the condition comprises dropping a ball.

5. The method of claim 1, wherein the condition comprises radio frequency signal.

6. The method of claim 1, wherein the condition is a change in a flow rate.

7. The method of claim 1, wherein the condition is a predetermined temperature.

8. The method of claim 1, wherein the actuator includes a linear actuator adapted to open or close the valve.

9. The method of claim 1, wherein the sensor is an acoustic sensor.

10. The method of claim 1, wherein the sensor is an electromagnetic sensor.

11. The method of claim 1, wherein the sensor is a temperature transducer.

12. The method of claim 1, wherein the sensor is a vibration sensor.

13. The method of claim 1, further comprising closing the valve upon completion of cementing.

14. The method of claim 13, further comprising drilling through the valve.

15. The method of claim 14, wherein the drillable valve comprises cement.

16. The method of claim 14, wherein the drillable valve comprises plastic.

17. The method of claim 14, wherein the drillable valve.

18. The method of claim 1, wherein the sensor is located in the drillable material.

19. The method of claim 1, wherein the condition comprises a pressure.

20. The method of claim 19, wherein the pressure is an increase in fluid pressure downhole created uphole.

21. The method of claim 1, further comprising drilling through the downhole valve with an earth boring drill bit.

22. The method of claim 21, further comprising drilling through the earth with the earth boring drill bit.

23. The method of claim 21, wherein the radio frequency tag reader is coupleable to the drillable material.

24. The method of claim 21, wherein the radio frequency tag reader is located at least partially within the drillable material.

25. A method for remotely actuating a downhole tool, comprising:
- providing the downhole tool with a radio frequency tag reader, wherein the downhole tool comprises:
  - a collar;
  - a float valve; and
  - a drillable material for coupling the float valve to the collar;
- broadcasting a signal;
- positioning a radio frequency tag proximate the drillable material;
- generating a reflected signal; and
- actuating the downhole tool according to the reflected signal; and
- drilling through the downhole tool upon completion.

26. The method of claim 25, wherein the radio frequency tag comprises a passive radio frequency tag.

27. The method of claim 25, further comprising positioning a second radio frequency tag proximate the down hole tool.

28. The method of claim 27, further comprising actuating the downhole tool according to the reflected signal of the second radio frequency tag.

29. A method of performing a cementing operation to install a casing in a wellbore comprising:
- positioning the casing within the wellbore;
- locating a valve within an inner bore of the casing, the valve having a sensor and a flapper for opening and closing a valve bore;
- flowing cement through the valve and into an annulus between the wellbore and the casing;
- communicating with the sensor from the surface of the welibore;
- operating an actuator based on the communication from the surface; and
- closing the valve bore.

30. The method of claim 29, further comprising drilling through the valve after completion of the cementing operation with a drill bit.

31. The method of claim 29, wherein communicating from the surface comprises dropping a ball.

32. The method of claim 29, wherein communicating from the surface comprises changing a pressure.

33. The method of claim 29, wherein the valve further comprises:
- a collar for coupling the valve to the tubular;
- a float valve; and
- a drillable material for coupling the float valve to the collar.

34. The method of claim 29, further comprising drilling through the downhole valve with an earth boring drill bit.

35. The method of claim 33, wherein the sensor is located at least partially within the drillable material.

36. A downhole valve assembly for use in a downhole tubular comprising:

a valve located within an inner bore of the downhole tubular and the valve includes a flapper for opening and closing a valve bore, wherein the valve is composed of a drillable material;

a collar for coupling the valve to the tubular;

a drillable material for coupling the valve to the collar;

an actuator for operating the valve between an opened and a closed position;

a controller for activating the actuator; and a sensor for detecting a condition in the wellbore, wherein the detected condition is transmitted to the controller, thereby causing the actuator to operate the valve.

37. The downhole valve assembly of claim 36, wherein the sensor is located at least partially within the drillable material.

38. The down hole valve assembly of claim 36, wherein the actuator is located at least partially within the drillable material.

39. The downhole valve assembly of claim 36, wherein the controller is located at least partially within the drillable material.

40. The downhole valve assembly of claim 36, wherein the condition in the wellbore is generated at the surface.

41. The downhole valve assembly of claim 37, wherein the sensor comprises a radio frequency tag reader.

42. The downhole valve assembly of claim 37, wherein the sensor comprises a radio frequency tag.

43. The downhole valve assembly of claim 36, wherein the valve is a float valve.

44. The downhole valve assembly of claim 36, wherein the drillable material comprises cement.

45. The downhole valve assembly of claim 36, wherein the drillable material comprises plastic.

46. The downhole valve assembly of claim 36, wherein the drillable material comprises epoxy.

47. The downhole valve assembly of claim 36, wherein the downhole tubular is a casing.

48. The downhole valve assembly of claim 47, further including a drilling member engageable to the casing for drilling the wellbore.

49. The downhole valve assembly of claim 36, wherein the sensor is coupleable to the drillable material.

50. The downhole valve assembly of claim 36, wherein the drillable material is disposed between the valve and the collar.

* * * * *

UNITED STATES PATENT AND TRADEMARK OFFICE

CERTIFICATE OF CORRECTION

PATENT NO. : 7,252,152 B2
APPLICATION NO. : 10/464433
DATED : August 7, 2007
INVENTOR(S) : LoGiudice et al.

It is certified that error appears in the above-identified patent and that said Letters Patent is hereby corrected as shown below:

Column 11, Claim 17, Line 67, please delete "." and insert --comprises epoxy.--;

Column 12, Claim 27, Line 34, please delete "down hole" and insert --downhole--.

Signed and Sealed this

Twenty-seventh Day of May, 2008

JON W. DUDAS
*Director of the United States Patent and Trademark Office*